US011153692B2

(12) United States Patent
Kamkar-Parsi et al.

(10) Patent No.: US 11,153,692 B2
(45) Date of Patent: Oct. 19, 2021

(54) METHOD FOR OPERATING A HEARING SYSTEM AND HEARING SYSTEM

(71) Applicant: SIVANTOS PTE. LTD., Singapur (SG)

(72) Inventors: Homayoun Kamkar-Parsi, Erlangen (DE); Marko Lugger, Weilersbach (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/788,569

(22) Filed: Feb. 12, 2020

(65) Prior Publication Data

US 2020/0260196 A1 Aug. 13, 2020

(30) Foreign Application Priority Data

Feb. 13, 2019 (DE) ..... 102019201879

(51) Int. Cl.
*H04R 25/00* (2006.01)
*G10L 25/18* (2013.01)
*G10L 25/21* (2013.01)

(52) U.S. Cl.
CPC ..... *H04R 25/407* (2013.01); *G10L 25/18* (2013.01); *G10L 25/21* (2013.01); *H04R 25/405* (2013.01); *H04R 2225/43* (2013.01)

(58) Field of Classification Search
None
See application file for complete search history.

(56) References Cited

U.S. PATENT DOCUMENTS 9,712,928 B2 7/2017 Pedersen et al.
9,992,587 B2 6/2018 Farmani et al.
(Continued)

FOREIGN PATENT DOCUMENTS

CN 105848078 A 8/2016
CN 107690119 A 2/2018
(Continued)

OTHER PUBLICATIONS

Elior Hadad et al., "The Binaural LCMV Beamformer and its Performance Analysis", http://www.ieee.org/publications_standards/publications/rights/index.html, vol. 24, No. 3, p. 543-558, Mar. 2016.

(Continued)

*Primary Examiner* — Paul W Huber
(74) *Attorney, Agent, or Firm* — Laurence A. Greenberg; Werner H. Stemer; Ralph E. Locher

(57) ABSTRACT

A method operates a hearing system that has a first input transducer, a second input transducer and a signal processing device. An activity of a lateral useful signal source in an environment of the hearing system is ascertained by a first input signal being generated via an acoustic signal that impinges on the first input transducer, and a second input signal being generated via the acoustic signal that impinges on the second input transducer. A filtered input signal is generated via a directional notch filter based on the first and second input signals. A measure for attenuation that the directional notch filter causes is ascertained based on the filtered input signal and on the first and/or second input signals. The measure is compared with a reference, and from this comparison, the presence or absence of activity of the lateral useful signal source in the surroundings is inferred.

14 Claims, 2 Drawing Sheets

(56) References Cited

U.S. PATENT DOCUMENTS

| | | | |
|---|---|---|---|
| 10,063,980 | B2 | 8/2018 | Rosenkranz et al. |
| 10,079,026 | B1 | 9/2018 | Ebenezer |
| 10,219,083 | B2 | 2/2019 | Farmani et al. |
| 10,349,189 | B2 | 7/2019 | Kamkar-Parsi et al. |
| 10,469,962 | B2 | 11/2019 | Chen et al. |
| 10,547,956 | B2 | 1/2020 | Kamkar-Parsi et al. |
| 10,638,239 | B2 | 4/2020 | Kamkar-Parsi et al. |
| 10,659,891 | B2 | 5/2020 | Kuriger et al. |
| 10,755,731 | B2 | 8/2020 | Suzuki et al. |
| 10,911,877 | B2 | 2/2021 | De Vries et al. |
| 2012/0275622 | A1 | 11/2012 | Gobeli et al. |
| 2017/0054528 | A1* | 2/2017 | Pedersen ..... H04L 1/08 |
| 2017/0099550 | A1 | 4/2017 | Blessing et al. |
| 2018/0007478 | A1 | 1/2018 | Nikles et al. |
| 2018/0090158 | A1 | 3/2018 | Jensen et al. |
| 2018/0176694 | A1* | 6/2018 | Kamkar-Parsi ..... H04R 25/405 |
| 2018/0288535 | A1 | 10/2018 | De Vries et al. |

FOREIGN PATENT DOCUMENTS

| | | | |
|---|---|---|---|
| CN | 107708045 | A | 2/2018 |
| CN | 107872762 | A | 4/2018 |
| CN | 107889554 | A | 4/2018 |
| CN | 108235207 | A | 6/2018 |
| CN | 108600907 | A | 9/2018 |
| CN | 108694956 | A | 10/2018 |
| DE | 102016225205 | A1 | 6/2018 |
| EP | 3291581 | A2 | 3/2018 |
| EP | 3340655 | A1 | 6/2018 |
| JP | 2018040982 | A | 3/2018 |
| JP | 2018098796 | A | 6/2018 |
| JP | 2018098797 | A | 6/2018 |
| JP | 2018098798 | A | 6/2018 |
| WO | 2018038820 | A1 | 3/2018 |

OTHER PUBLICATIONS

Daniel Marquardt et al., "Performance Comparison of Bilateral and Binaural MVDR-based Noise Reduction Algorithms in the Presence of DOA Estimation Errors", www.sigproc.uni-oldenburg.de, ITG-Fachbericht 267: Speech Communication, p. 130-134, Oct. 5-7, 2016 in Paderborn.

A. Homayoun Kamkar-Parsi et al., "Improved Noise Power Spectrum Density Estimation for Binaural Hearing Aids Operating in a Diffuse Noise Field Environment", IEEE Transactions on Audio, Speech, and Language Processing, vol. 17, No. 4, p. 521-533, May 2009.

Rainer Martin, "Noise Power Spectral Density Estimation Based on Optimal Smoothing and Minimum Statistics" IEEE Transactions on Speech and Audio Processing, vol. 9, No. 5, p. 504-512, Jul. 2001.

* cited by examiner

METHOD FOR OPERATING A HEARING SYSTEM AND HEARING SYSTEM

CROSS-REFERENCE TO RELATED APPLICATION

This application claims the priority, under 35 U.S.C. § 119, of German application DE 10 2019 201 879, filed Feb. 13, 2019; the prior application is herewith incorporated by reference in its entirety.

BACKGROUND OF THE INVENTION

Field of the Invention

The invention relates to a method of operating a hearing system that has a first input transducer, a second input transducer and a signal processing device. The invention additionally relates to such a hearing system.

A hearing system typically has one hearing system and in many cases two hearing systems or is trained by two hearing devices. "Hearing devices" usually refer to classic hearing aids, which are used for the care of the hearing impaired. In a broader sense, however, this term also encompasses devices that are configured to support normally-hearing people. Such hearing devices are also known as "Personal Sound Amplification Products" or "Personal Sound Amplification Devices" (abbreviated: "PSAD") and are not intended to compensate for hearing loss, but are used specifically to support and improve normal human hearing in specific hearing situations; for example, for hunters during hunting or wildlife observation, to better perceive animal sounds and other noises animals generate; for sports reporters, to enable improved speaking and/or speech comprehension with complex background noise; for musicians, to reduce the strain on the hearing, and so forth.

Irrespective of the intended use, typical essential components of hearing devices are an input transducer, a signal processing device and an output transducer. The input transducer is usually an acousto-electric transducer, for example a microphone, and/or an electromagnetic receiver, for example an induction coil. For the output transducer, an electro-acoustic transducer, for example a miniature loudspeaker, or an electromechanical transducer, for example a bone conduction receiver, is typically used. The signal processing device is typically implemented by an electronic circuit realized on a printed circuit board, and usually contains an amplifier. The device is used to process input signals that are generated during the operation of a hearing device when ambient sound strikes the input transducer, and to generate output signals based on the input signals, which the output transducer converts and thus renders audible.

For processing the input signals, depending on the current hearing situation different algorithms are preferably used that are adapted to different hearing situations that are expected to occur. The individual hearing situations to be expected are characterized, for example, by frequently recurring patterns of superimpositions of a useful signal sound by background noise, or in general by noise, the patterns being typified by, among other things, the type of noise occurring, the signal-to-noise ratio, the frequency response of the useful signal sound and/or time variations and mean values of these variables.

A prerequisite for automatic switching between these different algorithms is the recognition of the respectively current hearing situation or at least the recognition of a change in a current hearing situation.

SUMMARY OF THE INVENTION

On this basis, the object of the invention is to indicate an advantageous method of operating a hearing system as well as an advantageously designed hearing system.

According to the invention, this object is accomplished by a method with the features of the independent method claim 1 and by a hearing system with the features of the independent hearing system claim. Preferred refinements are included in the dependent claims. The advantages and preferred configurations mentioned with regard to the method may be transferred analogously to the hearing system and vice versa.

The method is used for operating a hearing system, in particular a hearing system of the type mentioned above, the hearing system having a first input transducer, a second input transducer and a signal processing device. In the course of carrying out the method, the environment or surroundings of the hearing system are monitored for activity of a lateral useful signal source and accordingly, the activity of a lateral useful signal source in the hearing system environment is ascertained by the method.

This occurs by a first input signal being generated via an acoustic signal from the environment that impinges on the first input transducer, and a second input signal being generated via the acoustic signal that impinges on the second input transducer. A filtered input signal then is generated via a directional notch filter based on the first input signal and the second input signal. A measure of an attenuation that the directional notch filter unit causes is ascertained based on the filtered input signal and based on the first input signal, and/or based on the second input signal. Finally a measure is compared with a reference, and from this comparison, the presence or absence of activity of a lateral useful signal source in the surroundings of the hearing system is inferred.

The method according to the invention is based in particular on a basic idea of comparing two attenuation effects. One of the two attenuation effects describes an attenuation of a signal to be examined, i.e. in particular an attenuation of the first input signal and/or the second input signal, by a kind of fading out in a solid angle range in which there is suspected to be an active lateral useful signal source. This first attenuation effect is compared to a second attenuation effect that would occur if only a portion of diffuse background noise is suppressed by masking the corresponding solid angle range. If the first attenuation effect is then significantly greater than the second attenuation effect, an activity of a lateral useful signal source may be assumed; if not, it may be assumed that there is no activity of a lateral useful signal source.

The useful signal source is typically a conversation partner, i.e. a person who at least temporarily speaks while facing toward a wearer of the hearing system. Such a useful signal source is a lateral useful signal source if the hearing system wearer is not looking toward the useful signal source when looking straight ahead, i.e. if the useful signal source is located away from or laterally offset from the viewing direction of the hearing system wearer. A useful signal source that is in the hearing system wearer's direction of vision is referred to below as a central useful signal source.

Differentiating in this way between a central useful signal source and a lateral useful signal source, and recognizing when a lateral useful signal source is currently active, i.e. when a laterally-offset conversation partner is speaking, is particularly advantageous when a wearer of the hearing system is conversing with a plurality of conversation partners and accordingly different useful signal sources are active alternately. By detecting the activity of such a lateral useful signal source, it is then possible, for example, to process the first and/or second input signal to generate an output signal differently, depending on whether a lateral useful signal source is active or not.

To make it possible to detect the presence or absence of activity of a lateral useful signal source in the hearing system environment, the above-mentioned measure is compared to the above-mentioned reference. In other words, a comparison is made between the measure obtained and the reference, for example by relating the measure to the reference. In this case, the system typically only ascertains whether the ratio or the magnitude of the ratio is greater or less than one.

According to another exemplary embodiment, a difference is taken, and it is ascertained whether the difference or the magnitude thereof is greater or less than zero or greater or less than a predetermined threshold value. If, for example, comparing the measure and the reference reveals that the measure is significantly smaller than the reference, it is ascertained that an activity of a lateral useful signal source is present; in contrast, if the measure is larger than the reference, it is ascertained that an activity of a lateral useful signal source is absent.

Preferably, the obtained measure is an attenuation factor or a logarithmic attenuation measure, the attenuation factor or logarithmic attenuation measure typically being time-dependent. The reference also preferably represents an attenuation factor or a logarithmic attenuation measure, and this attenuation factor or logarithmic attenuation measure is also typically time-dependent. Thus, preferably two attenuation factors or two logarithmic attenuation measures are compared.

To obtain the measure, the above-mentioned filtered input signal is first generated; a directional notch filter unit is used for this purpose. The filtered input signal preferably corresponds, at least in good approximation, to one or a plurality of input signals of a hearing system with a variable directional characteristic, with the directional characteristic being such that a specific spatial region or solid angle range in which a potential activity of a useful signal source is ascertained is faded out, so that components of an acoustic signal from this solid angle range are, essentially, not taken into account.

For this purpose, it is ascertained in which direction the potential activity of a useful signal source is located in relation to the hearing system, and in order to generate the filtered input signal, a predetermined solid angle range, also simply called an angular range, for example an angular range of 10°, is then faded out around the corresponding direction or the associated angular position. However, the area around the central angular position, i.e. around the viewing direction of the hearing system wearer when looking straight ahead, is excluded or not taken into account when ascertaining the potential activity of a useful signal source. The potential activity of a useful signal source, in turn, is ascertained, for example, when a predetermined threshold value for a signal level in a solid angle range is exceeded. The reference angular position, i.e. the 0° angular position, is advantageously fixed to the aforementioned central angular position, i.e. to the wearer's direction of view when looking straight ahead, but this is not mandatory.

At least the basic principle (adaptive spatial notch beamforming) of directional notch filter units should be regarded as known here. Two types are of particular importance, namely a first type that uses the "Binaural Minimum Variance Distortionless Response Beamforming (MVDR)" method and a second type that uses the "Binaural Linearly Constrained Minimum Variance Beamforming (LCMV)" method. The first type is described in greater detail, for example, in E. Hadad, S. Doclo and S. Gannot, "Binaural LCMV Beamformer and its Performance Analysis", IEEE Tran. On Audio, Sp., and Lang. Proc., August 2015. The preferred second type is described in greater detail, for example, in D. Marguardt and S. Doclo, "Performance Comparison of Bilateral and Binaural MVDR-based Noise Reduction Algorithms in the Presence of DOA Estimation Errors", in Speech Communication, 12th ITG Symposium, 2016, pp. 1-5.

Also preferred is a variant embodiment of the method, in which the reference is not simply predetermined in the form of a reference value, for example, but is ascertained by obtaining a spectral power density for interference noise based on the first input signal and/or the second input signal or by obtaining a quantity derived from this spectral power density for interference noise. For the purposes of this application, background noise is considered to be preferably background noise generated by persons who are not in conversation with the hearing system wearer, for example, persons who are conversing with others. Thus, the noise contains in particular so-called background chatter, which may be encountered for example in a cafeteria or public place. Such background noise or interference noise typically occurs as diffuse interference noise, i.e. interference noise that cannot be unambiguously assigned to a source with a specific position and is not directly directed at the hearing system wearer.

For example, a preferred method for obtaining such a spectral power density for interference noise is described in more detail in A. H. Kamkar-Parsi and M. Bouchard, "Improved Noise Power Spectrum Density Estimation for Binaural Hearing Devices Operating in a Diffuse Interference Noise Field Environment", IEEE Trans. Audio, Speech, Lang. Process, vol. 17, no. 4, pp. 521-533, May 2009. An alternative method is described for example in R. Martin, "Noise Power Spectral Density Estimation Based on Optimal Smoothing and Minimum Statistics", IEEE Trans. Speech Audio Process., vol. 9, no. 5, pp. 504-512, July 2001.

A quantity derived from the spectral power density for interference noise is preferably a current interference noise power, a current power value for interference noise, or a current average power value for interference noise, for an interference noise power that is derived from the first input signal and/or second input signal, typically over a predetermined time period and usually over a predetermined frequency band.

A corresponding current power value for interference noise is then obtained for a predetermined first time interval, for example a first time interval of about 10 ms, and a predetermined frequency band. The predetermined frequency band is expediently oriented toward human speech, although the entire frequency spectrum of human speech from about 80 Hz to about 12 kHz is not necessarily covered. Instead, in some cases a frequency band is predetermined that which comprises frequencies from about 100 Hz to about 500 Hz. A frequency band from about 125 Hz to about 4 kHz is preferable.

Also preferred are corresponding current power values for interference noise at intervals of a predetermined second time interval, for example a second time interval of about 100 ms; in that case, it is typically assumed that each obtained current power value for interference noise is constantly valid for the duration of the predetermined second time interval, so that a time progression of the current interference noise power over the predetermined frequency spectrum may be, and preferably is, derived from this.

According to another preferred approach, the frequency components that are taken into consideration are weighted, and a weighted average is taken, in particular for example based on the frequency components over a frequency band from about 125 Hz to about 4 kHz.

In one advantageous refinement, a parameter value is also obtained for at least one correction parameter by the directional notch filter unit, or a corresponding parameter value for the at least one correction parameter is specified in particular by the configuration of the directional notch filter unit. The at least one correction parameter or the correction parameters are in particular adaptive filter coefficients of the directional notch filter unit. The number of correction parameters, in this case, usually corresponds to the number of channels or input signals used.

A modified spectral power density for interference noise or a modified derived variable is then further preferably obtained based on the spectral power density for interference noise or on the basis of the variable derived therefrom and by means of the parameter value for the at least one correction parameter or the parameter values of the correction parameters, i.e. for example a time progression for a modified current interference noise power over the predetermined frequency spectrum starting from a time progression for the current interference noise power over the predetermined frequency spectrum.

By way of example, an obtained spectral power density for interference noise S is assumed, as well as correction parameters P1 and P2, and the correction parameters represent adaptive filter coefficients of the directional notch filter unit. As a result, in particular, the parameter values P1 and P2 vary with the spatial position of the notch of the directional notch filter unit. In this case, the modified spectral power density for interference noise S*, for example, is determined via the relationship:

$$S^*=(|P1|^2+|P2|^2)S.$$

Moreover, for example, a time progression of the current interference noise power over the predetermined frequency spectrum is first derived from the first input signal and/or second input signal. To obtain the modified derived variable, i.e. the modified current interference noise power, it is then further assumed that the line for interference noise is always distributed equally in all spatial directions, as expected for diffuse background noise. If this is the case, the parameter value for the at least one correction parameter or the parameter values for the correction parameters specify, for example, the width or size of the spatial region that is faded out by means of the directional notch filter unit to obtain the measure. Using this information, finally, from the current interference noise power, the modified current interference noise power is derived, which corresponds to the portion of the current interference noise power that the directional notch filter unit fades out as a result of fading out the spatial region.

Furthermore, in an advantageous variant of the method, the spectral power density for interference noise or the modified spectral power density for interference noise is compared with a total spectral power density to obtain the reference, the total spectral power density being obtained based on the first input signal and/or second input signal. Alternatively, to obtain the reference, a quantity derived before the spectral power density for interference noise, a modified derived quantity for interference noise or a quantity derived from the modified spectral power density for interference noise is compared with a quantity derived from the total spectral power density. The total spectral power density, in this case, is preferably simply the total power from the first input signal and/or second input signal.

According to one variant embodiment, the reference reflects, for example, the attenuation of a current total power in the event that the current total power is reduced by the above-described modified current interference noise power. The current total power, in this case, is obtained analogously to the current interference noise power. The same time intervals and the same frequency band are thus specified, but virtually all the power from the first input signal and/or second input signal is taken into account, i.e. the total spectral power density is taken as a basis. The reference, or rather the current reference, in this case reflects a current attenuation factor or a current logarithmic attenuation measure.

It is also favorable if, in order to obtain the measure, a spectral power density for the filtered input signal is obtained and compared with a total spectral power density, in particular the above-described total spectral power density, the total spectral power density being obtained based on the first input signal and/or second input signal.

It is also advantageous to work with derived values, particularly with current values for power, when obtaining the dimension. Therefore, to obtain the measure, a current filtered input signal power is preferably compared to a current total power, which in particular corresponds to the above-described current total power. Again, for the purpose of comparability, the same time intervals and frequency band are specified, as for example in the case of the current interference noise power. In this case, the measure, or rather the current measure, then also reflects a current attenuation factor or a current logarithmic attenuation measure.

If the measure and the reference then each respectively reflect a current attenuation factor or a current logarithmic attenuation measure, they may be easily compared and contrasted with each other, for example by taking a difference. For this purpose, for example, the measure or current measure and the reference or current reference are fed to a comparator unit. The comparator unit then preferably outputs a binary decision signal with two possible values; one value stands for the presence of the activity of a lateral useful signal source, and the other value stands for the absence of activity of a lateral useful signal source.

In an advantageous refinement, an offset value is also specified for the comparator unit, by which the decision threshold is shifted. In this way the difference is then preferably determined at which the output signal of the comparator unit switches between the measure and the reference, i.e. for example how much larger or how much smaller the measure must be than the reference in order to ascertain that an activity of a lateral useful signal source is present. By varying this offset value, the compromise between sensitivity and error susceptibility is typically shifted towards sensitivity or towards error susceptibility.

As explained above, the above-described method or above-described part of the method according to the invention is used to monitor the hearing system environment for activity of a lateral useful signal source. The monitoring allows the detection of the presence of an activity of a lateral useful signal source and this is used in an advantageous refinement to control the hearing system and in particular to activate or start an auxiliary function, with the auxiliary function preferably being activated and consequently executed upon ascertaining activity of a lateral useful signal source in the hearing system environment. Activity detection in this case preferably functions as a kind of trigger that triggers the start of the auxiliary function whenever activity of a lateral useful signal source is ascertained in the hearing system environment.

According to an advantageous variant embodiment, using the auxiliary function, a suitable hearing program is selected based on the current hearing situation, or two hearing programs are simply switched back and forth between, depending on whether the presence or absence of activity of a lateral useful signal source is detected. This means, for example, that the hearing system operates with a first hearing program for as long as the absence of an activity of a lateral useful signal source is detected, and that the hearing system operates with a second hearing program for as long as the presence of an activity of a lateral useful signal source is detected.

Also advantageous is a method variant according to which an output signal is generated by the signal processing device as a function of at least one parameter value, for at least one signal processing parameter, and according to which the at least one parameter value is adapted to a current hearing situation by use of the auxiliary function. For example, based on the at least one parameter value, beamforming is performed and the directional characteristic of the hearing system is typically adapted by adjusting the at least one parameter value.

Also advantageous is a variant of the method in which the auxiliary function is used to obtain a relative position or relative location of a lateral useful signal source relative to the hearing system. This relative position or location in particular describes the direction in which a lateral useful signal source is encountered, relative to the direction of vision of the hearing system wearer when looking straight ahead. In an advantageous refinement, the relative position or relative location is not only determined once, but instead the relative position or relative location of the lateral useful signal source is subsequently tracked to the extent possible.

The above-described method according to the invention is, as previously explained, for the operation of a hearing system and is accordingly configured for a hearing system. A hearing system according to the invention is in turn set up to perform the above-described method in at least one operating mode and has a first input transducer, second input transducer and signal processing device. During operation of the hearing system, with the first input transducer a first input signal is generated and with the second input transducer a second input signal is generated; depending on the embodiment of the hearing system, the first input signal and/or second input signal is/are not exclusively used for implementing the method according to the invention described herein. Instead, the two input signals, i.e. the first input signal and second input signal, are typically provided in such a way that one of the input signals or both input signals may be or are supplied in parallel to a plurality of signal processing processes, as required.

The principles described above for this signal processing may be implemented irrespective of whether analog signals are present and analog signal processing is performed, or digital signals are present and digital signal processing performed. Thus, in those variant embodiments of the method according to the invention, or depending on the implementation of the method according to the invention, the above-described first input signal and the above-described second input signal are either analog signals or digital signals. Preferably, however, these are digital signals and the signal processing is preferably digital signal processing, for example using a microprocessor, which in particular in that case is part of the signal processing device. The above-described sub-steps of the method are then usually executed and implemented with the help of logical or virtual blocks.

Irrespective of whether analog signal processing or digital signal processing is used, the hearing system is preferably configured so that there is a time delay of less than about 100 ms between a change in activity of a lateral useful signal source, i.e. a start or end of an activity, and the detection of the change by the hearing system.

The hearing system also expediently has a first hearing device and a second hearing device. Preferably, the first input transducer is part of the first hearing device and the second input transducer is part of the second hearing device. Alternatively, the first input transducer and second input transducer are part of the first hearing device.

In some variant embodiments, the hearing system also has one or more input transducers in addition to the first input transducer and second input transducer, which generate additional input signals in addition to the first input signal and second input signal. The other input signals are then preferably used additionally for obtaining the reference and/or the measure. For example, a proximity detector of the hearing system is also used as an additional input transducer and to generate an additional input signal.

Other features which are considered as characteristic for the invention are set forth in the appended claims.

Although the invention is illustrated and described herein as embodied in a method for operating a hearing system and a hearing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Parts that correspond to each other are respectively assigned the same reference signs in all drawings.

Figure 1:
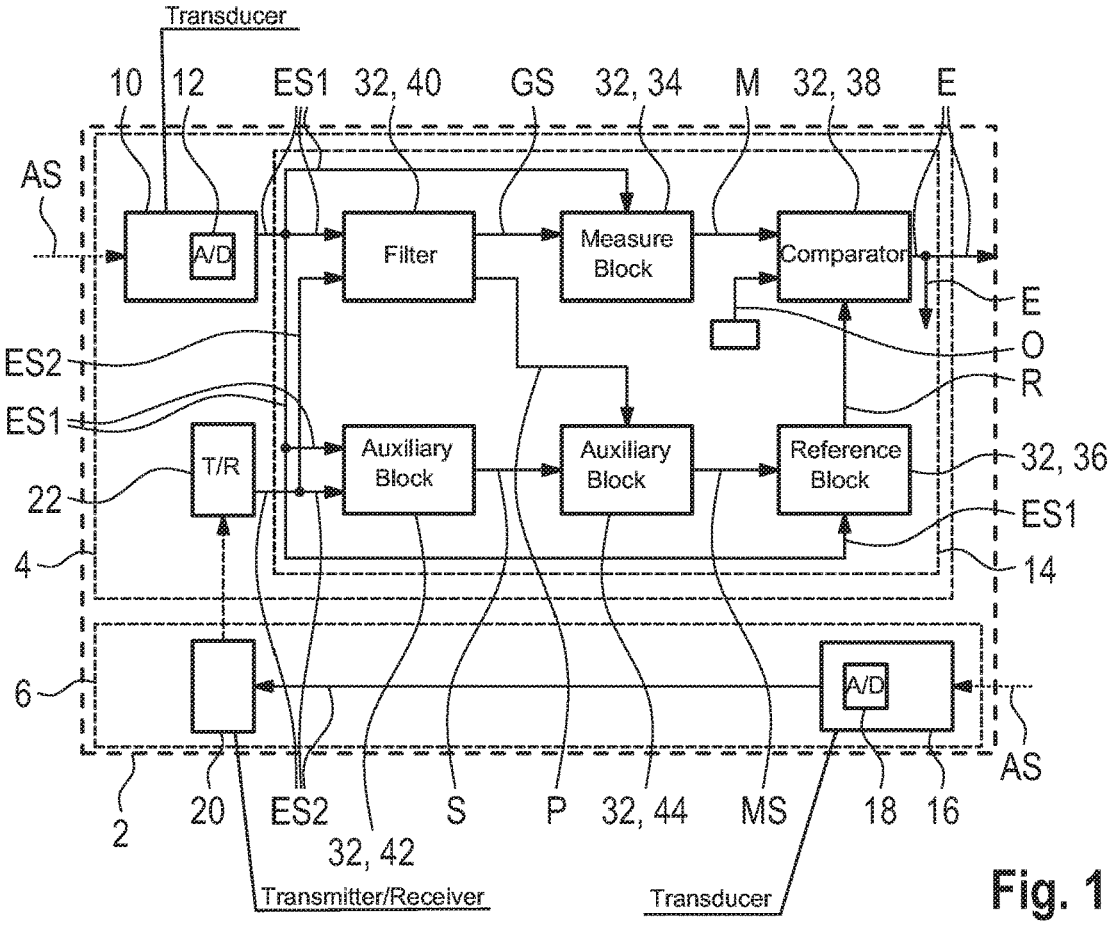
FIG. 1 block diagram of a hearing system according to the invention.

Referring now to the figures of the drawings in detail and first, particularly to FIG. 1 thereof, there is shown a hearing system 2 described below by way of example in a block diagram is preferably configured as a binaural hearing system 2 and expediently has a first hearing device 4 and a second hearing device 6. In the exemplary embodiment, the first hearing device 4 is worn on or in the left ear during use by a wearer 8 and at the same time, the second hearing device 6 is worn on or in the right ear.

The first hearing device 4 has a first input transducer 10, by which a first input signal ES1 is generated during operation by an acoustic signal AS impinging on the first input transducer 10. First, an analog signal is generated, which is then converted into a digital signal by a first A/D converter 12 and in this form is made available to a signal processing device 14 as the first input signal ES1. The signal processing device 14 typically has a microprocessor or computer chip or is formed by a corresponding electronic assembly.

The second hearing device 6 in turn has a second input transducer 16 and, analogously to the first hearing device 4, a second input signal ES2 is generated as a result of the acoustic signal AS impinging on the second input transducer 16 during operation of the second hearing device 6. Here again, an analog signal is first generated and this is then converted into a digital signal by a second A/D converter 18, thus providing the second input signal ES2. The second hearing device 6 also has a second transmitting/receiving unit 20, by which the second input signal ES2 is transmitted to the first hearing device 4 and received there by a first transmitting/receiving unit 22. The second input signal ES2 is made available to the signal processing device 14 in the first hearing device 4, so that both the first input signal ES1 and the second ES2 input signal are available to the signal processing device 14.

Using the signal processing device 14, in the exemplary embodiment, a method according to the invention is carried out in at least one operating mode, and using that method, an activity of a lateral useful signal source 24 in a hearing system environment 2 is ascertained. The first hearing device 4, which is worn in or at the left ear, monitors primarily the left half space from the perspective of the wearer 8, and the second hearing device 6, which is worn in or at the right ear, monitors primarily the right half space. Thus, although not shown, the second hearing device 6 also has a signal processing device. In addition, the first hearing device 4 transmits the first input signal ES1 to the second hearing device 6 in parallel, so that both input signals ES1, ES2 are also made available to the signal processing device of the second hearing device 6. In both hearing devices 4, 6, respectively, the below-described method according to the invention is then carried out. Both hearing devices 4, 6 carry out the method according to the invention in parallel.

Figure 2:
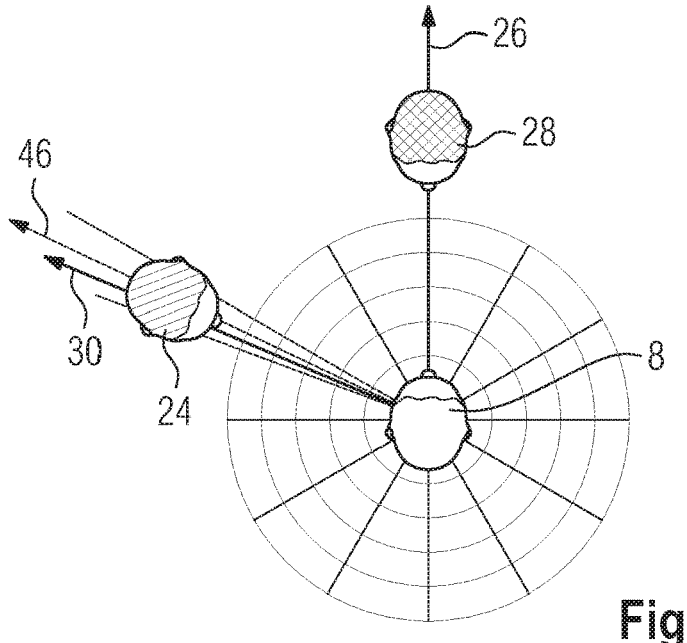
FIG. 2 top view of a hearing situation with three conversation partners, with one of the conversation partners wearing the hearing system.

In the following, a hearing situation as shown in FIG. 2 is assumed. Here, approximately central in the lower part of the illustration, the wearer 8 of the hearing system 2 is shown, whose direction of vision determines a central direction 26 when looking straight ahead. A first conversation partner is located in front of the wearer 8 in the central direction 26, as a central useful signal source 28. This is shown in the top center of FIG. 2, which shows an overhead view of the hearing situation. Somewhat to the left is a second conversation partner, arranged in a lateral direction 30 as seen from the standpoint of the wearer 8; the lateral direction 30 and central direction 26 in the exemplary embodiment enclose an angle of about 70°. The second conversation partner is thus in a lateral position as seen from the standpoint of the wearer 8, at least when looking in a central direction 26 when looking straight ahead. The method described below now serves to detect when the second conversation partner representing a lateral useful signal source 24 is speaking, i.e. when an activity of this lateral useful signal source 24 is present.

To this end, the first input signal ES1 and second input signal ES2 are processed in the signal processing device 14, in particular in such a way that the first input signal ES1 and second input signal ES2 are made available to a plurality of blocks 32 for signal processing in parallel. This means that preferably a plurality of these blocks 32 may access the two input signals ES1, ES2 independently of each other and may use these as a basis for signal processing processes.

The various signal processing blocks 32 are typically not realized by different quadrupoles or other electronic assemblies, but by virtual units, for example by different programs or processes that may be executed in parallel. In the exemplary embodiment, a measure block 34, a reference block 36, a comparator unit 38, a directional notch filter unit 40, a first auxiliary block 42 and a second auxiliary block 44 are implemented as blocks 32 for signal processing.

In the directional notch filter unit 28, a filtered input signal GS is generated based on the first input signal ES1 and second input signal ES2. For this purpose, a directional characteristic is simulated by which, in essence, a predetermined solid angle range around a source direction 46, represented in FIG. 2 by two dashed lines flanking the source direction 46, for example a solid angle range of 10° around the source direction 46, is faded out, so that portions of the incident acoustic signal AS originating from this solid angle range are cancelled or faded out. The corresponding components are then no longer represented in the filtered input signal GS.

However, the source direction 46 is not fixedly predetermined, but varies in time and is ascertained in a separate parallel process, in particular in such a way that the source direction 46 points toward a potential lateral useful signal source. The transverse direction is therefore, strictly speaking, either a current source direction 46 or a time-varying source direction 46. For this purpose, an auxiliary signal is first generated again based on the first input signal ES1 and second input signal ES2. For this purpose, a directional characteristic is again simulated by which a predetermined solid angle range around the central direction 26, for example a solid angle range of 10° around the central direction 26, is faded out, so that parts of the impinging acoustic signal AS that originate from this solid angle range are extinguished or faded out. In the auxiliary signal, the corresponding components are then no longer represented. In the remaining spatial region, the direction from which the strongest part of the incoming acoustic signal AS reaches the hearing system 2 is searched for. This direction is obtained as a source direction 46. Whenever the lateral useful signal source 24 is active, the source direction 46 coincides with the lateral direction 30 to a good approximation.

When the current source direction 46 is obtained, current parameter values P, which depend on the current source direction 46, may be calculated or derived for parameters with which the previously mentioned directional characteristic may be simulated. Using the parameter values P, the first input signal ES1 is then subjected to a filtering process, yielding the filtered input signal GS. In parallel to this, the second input signal ES2 is subjected to a filter process in an analogous manner in the second hearing device 6, using the parameter values P. In other words, typically both input signals ES1, ES2 are used to determine the source direction 46 and parameter values P, but preferably the filtered input signal GS is obtained from one of the two input signals ES1, ES2, in the first hearing device 4, i.e. from the first input signal ES1 or from the second input signal ES2.

In the measure block 34, a time-dependent measure M is then ascertained based on the first input signal ES1 and based on the filtered input signal GS, with the time-dependent measure M representing a logarithmic attenuation measure. For this purpose, based on the first input signal ES1, a current total power $P_G$ (ES1, Δt1, Δt2, Δf) is first obtained, which reflects the power of the acoustic signal AS that may be derived from the first input signal ES1 for a specified first time interval $\Delta t_1$ and for a specified frequency band Δf.

Expediently, the predetermined frequency band Δf is oriented toward human speech, although it does not necessarily cover the entire frequency spectrum of human speech from about 80 Hz to about 12 kHz, Instead, preferably a frequency band is predetermined that contains frequencies from about 125 Hz to about 4 kHz. Preferably, the individual frequency components are also weighted. For example, a weighted average is taken. For the first time interval $\Delta t_1$, for example, a time interval of 10 ms is specified. For each time interval of the quantity $\Delta t_1$, a power value may thus be determined, and corresponding power values are determined at intervals of a predetermined second time interval $\Delta t_2$, for example a second time interval $\Delta t_2$ of 100 ms; in that case, it is typically assumed that each determined power value is constantly valid for the duration of a time interval of the quantity $\Delta t_2$, so that a time progression for the total power $P_G$ (ES1, $\Delta t_1$, $\Delta t_2$, Δf) over the specified frequency spectrum may be, and preferably is, derived from this.

A first attenuated power $PD_1$ (GS, $\Delta t_1$, $\Delta t_2$, Δf) is obtained analogously, based on the filtered input signal GS. The time-dependent measure M=M(t) then results from the comparison:

$$M(t)=10\text{ dB } lg[P_{D1}(GS,\Delta t_1,\Delta t_2,\Delta f)/P_G(ES1,\Delta t_1,\Delta t_2,\Delta f)].$$

The first value for $P_{D1}$ (GS, Δt1, $\Delta t_2$, Δf) and for $P_G$ (ES1, Δt1, Δt2, Δf) is determined after a time period following the start of the method according to the invention at t=0 s.

Parallel to this measure M, a time-dependent reference R=R(t) is obtained by means of the signal processing device 14 and based on the two input signals ES1, ES2, i.e. the first input signal ES1 and second input signal ES2. To this end, both of the input signals ES1, ES2 are first evaluated together in the first auxiliary block 30 to identify diffuse interference noise, and a first interference signal S is obtained that only has those components of the first input signal ES1 that represent diffuse noise. The first interference signal S, having been obtained in this way, is then made available to the second auxiliary block 32. It should be mentioned that a second interference signal is ascertained analogously in parallel in the second hearing device 6, and this second interference signal has only those parts of the second input signal ES2 that represent diffuse interference noise.

In the second auxiliary block 32, the first interference signal S is subjected to the same filtering process as the first input signal ES1 using the parameter values P to obtain the filtered input signal GS, thus obtaining a first modified interference signal MS. This first modified interference signal MS is made available to the reference block 36.

The time-dependent reference R is then ascertained in the reference block 36, and the time-dependent reference in turn reflects a logarithmic attenuation measure. For this purpose, a second attenuated power $P_{D2}$ (MS, Δt1, Δt2, Δf) is ascertained in turn based on the first modified interference signal MS, using the same predetermined frequency band Δf and the same predetermined time intervals $\Delta t_1$ and $\Delta t_2$ as before. The time-dependent reference R=R(t) is then obtained from:

$$R(t)=10\text{ dB } lg[P_{D2}(MS,\Delta t_1,\Delta t_2,\Delta f)/P_G(ES1,\Delta t_1,\Delta t_2,\Delta f)].$$

Finally, the time-dependent measure M and the time-dependent reference R are fed to the comparator unit 38, where they are compared. If the time-dependent measure M is then significantly smaller than the time-dependent reference, it is ascertained that an activity of a lateral useful signal source is present; otherwise, it is ascertained that an activity of a lateral useful signal source is absent. For example, a binary decision signal E is generated by the comparator unit 38, for example with the values zero and one, with the value one representing the presence of an activity of a useful signal source and the value zero representing its absence.

Figure 4:
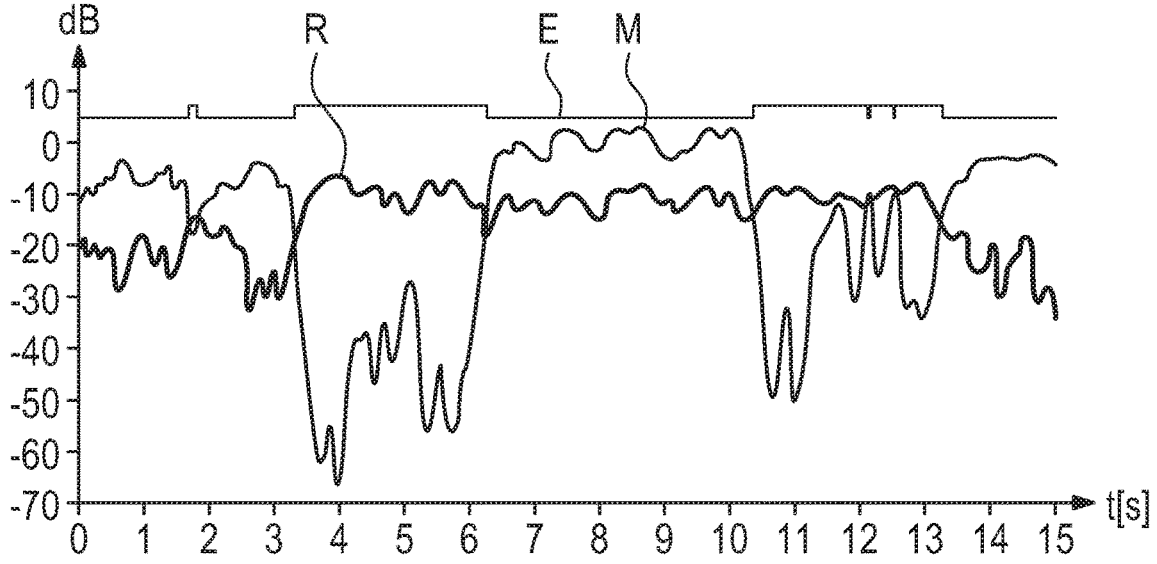
FIG. 4 is a diagram showing the temporal progressions of a measure, a reference and an output signal, as ascertained by the hearing system.

FIG. 4 shows a possible time progression of the measure M, the time-dependent reference R and the associated decision signal E. However, for the predetermined time intervals $\Delta t_1$ and $\Delta t_2$, smaller time intervals are used than the 10 ms and 100 ms mentioned by way of example. In addition, an offset value O is used that ensures that the value of the decision signal E changes to one only if the difference between the dimension M and the reference R is greater than or equal to a predetermined magnitude.

Figure 3:
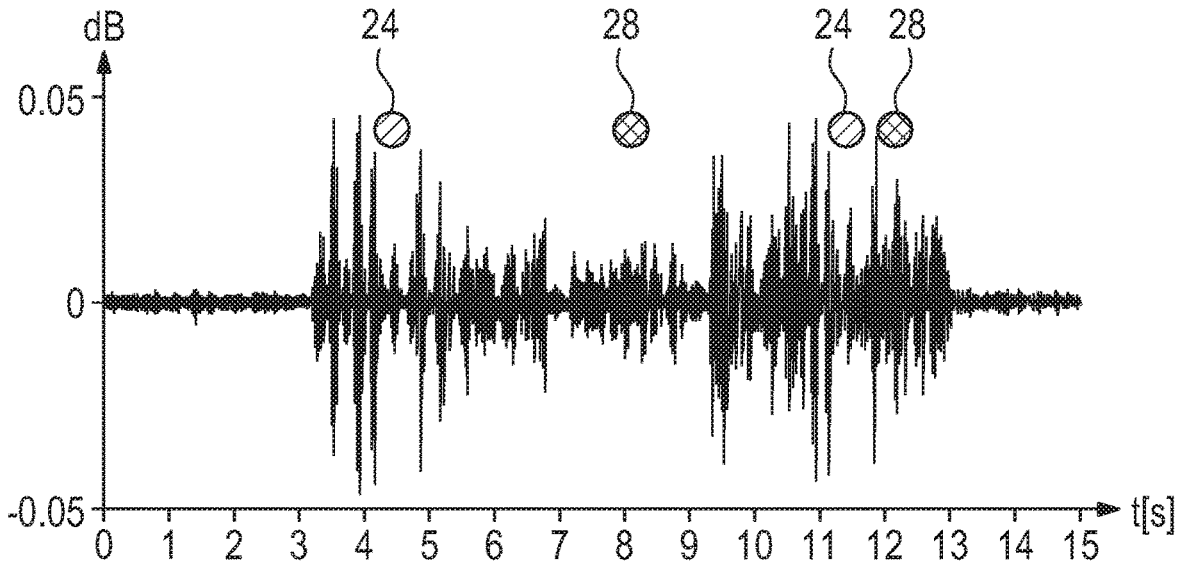
FIG. 3 is a diagram showing a time progression of one acoustic signal from a hearing situation.

For comparison, FIG. 3 also shows the associated time progression of a signal level representing the acoustic signal AS or the strength of the acoustic signal AS. Also marked are the times at which the lateral useful signal source 24 is active, namely from t=3 s to t=6 s and from t=10 s to t=13 s, and times at which the central useful signal source 28 is active, namely from t=6 s to t=10 s and from t=10 s to t=13 s. Diffuse interference noise is permanently present in the time period shown.

Preferably, the decision signal E is then also used to activate or deactivate an auxiliary function or to switch, for example, between two programs.

LIST OF REFERENCE SIGNS

2 Hearing system
4 First hearing device
6 Second hearing device
8 Wearer
10 First output transducer
12 First A/D converter
14 Signal processing device
16 Second output transducer
18 Second A/D converter
20 Second transmitting/receiving unit
22 First transmitting/receiving unit
24 Lateral useful signal source
26 Central direction
28 Central useful signal source
30 Lateral direction
32 Components for signal processing
34 Measure block
36 Reference block
38 Comparator unit
40 Directional notch filter unit
42 First auxiliary block
44 Second auxiliary block
46 Source direction
AS Acoustic signal
ES1 First input signal
ES2 Second input signal
GS Filtered input signal
P Parameters
M Measure
R Reference
S First interference signal MS First modified interference signal
E Decision signal
O Offset

The invention claimed is:

1. A method for operating a hearing system having a first input transducer, a second input transducer and a signal processor, wherein an activity of a lateral useful signal source in an environment of the hearing system being ascertained by the following steps of:

generating a first input signal from an acoustic signal from an environment that impinges on the first input transducer;

generating a second input signal from the acoustic signal that impinges on the second input transducer;

generating a filtered input signal via a directional notch filter based on the first input signal and the second input signal;

ascertaining a measure for an attenuation that the directional notch filter unit causes based on the filtered input signal and on the first input signal and/or the second input signal;

comparing the measure with a reference, wherein from a comparison, a presence or absence of the activity of the lateral useful signal source in surroundings of the hearing system is inferred; and ascertaining the reference by determining a spectral power density for interference noise, based on the first input signal and/or second input signal.

2. The method according to claim 1, which further comprises:

deriving a correction parameter by means of the directional notch filter, and wherein a modified spectral power density for the interference noise is determined based on the spectral power density for the interference noise and based on the at least one correction parameter; or determining a parameter value for the at least one correction parameter using the directional notch filter, and wherein based on the spectral power density for the interference noise and with an aid of the parameter value, the modified spectral power density for the interference noise is determined for the at least one correction parameter.

3. The method according to claim 2, which further comprises comparing the spectral power density for the interference noise or the modified spectral power density for the interference noise with a total spectral power density, to obtain the reference, wherein the total spectral power density is determined based on the first input signal and/or second input signal.

4. The method according to claim 1, which further comprises comparing the measure with the reference by feeding both the measure and the reference to a comparator.

5. The method according to claim 1, wherein an auxiliary function is executed when activity of the lateral useful signal source is ascertained in the environment of the hearing system.

6. The method according to claim 5, which further comprises using the auxiliary function to select a suitable hearing program based on a current hearing situation.

7. The method according to claim 5, which further comprises generating an output signal by means of the signal processor as a function of at least one parameter value for at least one parameter for signal processing, and wherein the at least one parameter value is adapted to a current hearing situation by means of the auxiliary function.

8. The method according to claim 7, which further comprises performing beamforming based on the at least one parameter value.

9. The method according to claim 5, which further comprises ascertaining a position of the lateral useful signal source relative to the hearing system by means of the auxiliary function.

10. A method for operating a hearing system having a first input transducer, a second input transducer and a signal processor, wherein an activity of a lateral useful signal source in an environment of the hearing system being ascertained by the following steps of:

generating a first input signal from an acoustic signal from an environment that impinges on the first input transducer;

generating a second input signal from the acoustic signal that impinges on the second input transducer;

generating a filtered input signal via a directional notch filter based on the first input signal and the second input signal;

ascertaining a measure for an attenuation that the directional notch filter unit causes based on the filtered input signal and on the first input signal and/or the second input signal, wherein to obtain the measure, a spectral power density for the filtered input signal is determined and compared with a total spectral power density, wherein the total spectral power density is determined based on the first input signal and/or second input signal; and comparing the measure with a reference, wherein from a comparison, a presence or absence of the activity of the lateral useful signal source in surroundings of the hearing system is inferred.

11. A hearing system, comprising:

a first input transducer;

a second input transducer; and a signal processor having a directional notch filter and configured, in at least one operating mode, to carry out a method to determine an activity of a lateral useful signal source in an environment of the hearing system, said signal processor configured to:

generate a first input signal from an acoustic signal from an environment that impinges on said first input transducer;

generate a second input signal from the acoustic signal that impinges on said second input transducer;

generate a filtered input signal via said directional notch filter based on the first input signal and the second input signal;

ascertain a measure for an attenuation that said directional notch filter unit causes based on the filtered input signal and on the first input signal and/or the second input signal;

compare the measure with a reference, wherein from a comparison, a presence or absence of the activity of the lateral useful signal source in surroundings of the hearing system is inferred; and ascertain the reference by determining a spectral power density for interference noise, based on the first input signal and/or second input signal.

12. The hearing system according to claim 11, further comprising a first hearing device, said first input transducer, said second input transducer and said signal processor are elements of said first hearing device.

13. The hearing system according to claim 11, further comprising:

a first hearing device, said first input transducer and said signal processor are elements of said first hearing device; and a second hearing device, said second input transducer is an element of said second hearing device, said second hearing device, is set up for communication with said first hearing device and for transmitting the second input signal to said first hearing device.

14. A hearing system, comprising:

a first input transducer;

a second input transducer; and a signal processor having a directional notch filter and configured, in at least one operating mode, to carry out a method to determine an activity of a lateral useful signal source in an environment of the hearing system, said signal processor configured to:

generate a first input signal from an acoustic signal from an environment that impinges on said first input transducer;

generate a second input signal from the acoustic signal that impinges on said second input transducer;

generate a filtered input signal via said directional notch filter based on the first input signal and the second input signal;

ascertain a measure for an attenuation that said directional notch filter unit causes based on the filtered input signal and on the first input signal and/or the second input signal, wherein to obtain the measure, a spectral power density for the filtered input signal is determined and compared with a total spectral power density, wherein the total spectral power density is determined based on the first input signal and/or second input signal; and compare the measure with a reference, wherein from a comparison, a presence or absence of the activity of the lateral useful signal source in surroundings of the hearing system is inferred.

* * * * *